US006942428B2

(12) United States Patent
Hannay et al.

(10) Patent No.: US 6,942,428 B2
(45) Date of Patent: Sep. 13, 2005

(54) CONDUCTOR POLYMER BACKFILL COMPOSITION AND METHOD OF USE AS A REINFORCEMENT MATERIAL FOR UTILITY POLES

(75) Inventors: Richard C. Hannay, Conroe, TX (US); Norman Kirby, Alvin, TX (US); Richard A. Owen, Conroe, TX (US)

(73) Assignee: Foward Ventures L.P., Arlington, TX (US)

( * ) Notice: Subject to any disclaimer, the term of this patent is extended or adjusted under 35 U.S.C. 154(b) by 0 days.

(21) Appl. No.: 10/434,014

(22) Filed: May 8, 2003

(65) Prior Publication Data

US 2003/0210959 A1 Nov. 13, 2003

Related U.S. Application Data

(60) Provisional application No. 60/379,203, filed on May 9, 2002.

(51) Int. Cl.[7] ..... E02D 5/64

(52) U.S. Cl. ..... 405/231; 405/232; 405/303; 52/170; 52/514.5; 252/500

(58) Field of Search ..... 405/232, 231, 405/233, 303; 52/169.13, 170, 514, 514.5; 524/495, 496, 439, 59, 590; 252/500; 521/83, 101, 155

(56) References Cited

U.S. PATENT DOCUMENTS

| | | | | | |
|---|---|---|---|---|---|
| 3,344,871 | A | | 10/1967 | Goodman | |
| 3,403,520 | A | | 10/1968 | Goodman | |
| 3,562,403 | A | * | 2/1971 | Monahan et al. | 52/515 |
| 3,564,859 | A | | 2/1971 | Goodman | |
| 3,611,736 | A | | 10/1971 | Goodman | |
| 3,798,186 | A | | 3/1974 | Nakade et al. | |
| 3,805,532 | A | | 4/1974 | Kistner | |
| 3,968,657 | A | | 7/1976 | Hannay | |
| 4,134,862 | A | | 1/1979 | Eden et al. | |
| 4,299,751 | A | | 11/1981 | Born | |
| 4,312,162 | A | * | 1/1982 | Medney | 52/309.16 |
| 4,629,585 | A | * | 12/1986 | McCracken et al. | 252/511 |
| 4,702,057 | A | * | 10/1987 | Phillips | 52/514 |
| 4,918,883 | A | * | 4/1990 | Owen et al. | 52/170 |
| 4,966,497 | A | | 10/1990 | Kirby | |
| 5,466,094 | A | | 11/1995 | Kirby et al. | |
| 5,553,438 | A | * | 9/1996 | Hsu | 52/170 |
| 6,319,181 | B1 | * | 11/2001 | Naoi et al. | 492/56 |
| 6,607,679 | B2 | | 8/2003 | Handa et al. | 252/513 |
| 6,620,343 | B1 | * | 9/2003 | Blok et al. | 252/511 |
| 6,660,795 | B2 | * | 12/2003 | Blok | 524/495 |

* cited by examiner

*Primary Examiner*—Frederick L. Lagman
(74) *Attorney, Agent, or Firm*—Fulbright & Jaworski LLP

(57) ABSTRACT

A conductive polymer backfill composition and method of use for setting or resetting utility poles is described. The backfill material is effective in simultaneously reinforcing and electrically grounding the utility pole.

32 Claims, No Drawings

CONDUCTOR POLYMER BACKFILL COMPOSITION AND METHOD OF USE AS A REINFORCEMENT MATERIAL FOR UTILITY POLES

CROSS-REFERENCE TO RELATED APPLICATIONS

This application claims priority to U.S. Provisional Application Ser. No. 60/379,203, filed on May 9, 2002.

TECHNICAL FIELD

The present invention relates generally to a method of setting or resetting poles in the ground and improving the grounding of same using rigid foam polyurethane resin. It more particularly relates to the improvement of the compositions used in setting or resetting poles and to methods using the compositions to set or reset poles.

BACKGROUND OF THE INVENTION

This invention is an improvement in known methods of setting or resetting poles in the ground, ground line protection of poles or encapsulation of pole treatment chemicals and enhancement of the strength to density ratio, of rigid foam polyurethane resins formed in-situ. The improvement resides in the use of compositions having electrical conductivity. The resulting electrical contact surface area of the pole to the earth is greatly enhanced relative to conventional grounding techniques.

The present invention is an improvement in the technology disclosed in U.S. Pat. Nos. 3,968,657 to Hannay, 5,466,094 to Kirby et al., 3,564,859 to Goodman, 3,403,520 to Goodman, and 4,966,497 to Kirby which describe related methods for resetting poles with foam plastic. The entire disclosures of U.S. Pat. Nos. 3,968,657, 3,564,859, 3,403,520, 4,966,497, and 5,466,094 are incorporated by reference as though fully set out herein.

In brief, U.S. Pat. No. 3,403,520 describes a method of setting pole forms in the ground by making a hole which is only slightly larger than the butt of the pole to be placed in the hole, placing the pole in the hole in the desired position, partially filling the hole with a reactive component mixture with a synthetic resin and a blowing agent and permitting the reaction to complete so as to expand the resinous foam into all the space between the pole and the sides of the hole. The expanded resinous foam adheres to and seals the surface of the embedded section of the pole protecting it from moisture, chemicals and rodents and sets the pole in the hole. The expanding resinous foam fills all the voids, surfaces, crevices and notches in the sides and bottom of the hole.

U.S. Pat. No. 3,564,859 describes a procedure for straightening and refilling the hole. It utilizes the same method as U.S. Pat. No. 3,403,520 for producing foam and for filling voids resulting when an existing installed pole has been realigned after it has been canted or tilted.

U.S. Pat. No. 3,968,657 was an improvement upon the in-situ reaction chemistry used to prepare the backfill material. The '657 patent disclosed the addition of a non-volatile water-immiscible material to the mixture so that properties of the resultant product are not affected excessively in the presence of groundwater.

A further improvement in the backfill-forming chemistry was described in U.S. Pat. No. 4,966,497. The '497 patent describes a procedure that is an improvement on the above methods because halogenated hydrocarbon blowing agents, more particularly chlorofluorocarbons, are not required.

Further, the composition decreased the cost per unit of the polyurethane foam.

U.S. Pat. No. 5,466,094 represented another improvement pole setting or resetting compositions and methods. In the '094 patent, the polyurethane forming chemistry was modified by stabilizing the highly reactive isocyanate component by pre-reaction to form a prepolymer.

All of the aforementioned patents are devoid of any teaching which describes a backfill composition or method which simultaneously sets or resets the pole and aids in the electrical grounding of the pole. A good ground connection effectively directs the excessive current from a lightening strike to the ground. Proper grounding also helps to insure the quality of the power being transmitted by helping to eliminate or minimize voltage spikes and interference such as RF signals from adversely affecting sensitive electronic equipment.

Grounding is an important "safety valve" of an electrical system, protecting both the system and persons working on the system. Proper grounding is important for a number of reasons. All electrical equipment requires grounding because of possible short circuits within the system. Electrical sensors, such as relays require a reference, which is oftentimes ground. Harmonics created by semiconductor equipment and unbalanced loads depend upon good ground to stabilize the system. The standard AC system in the U.S. operates at 60 cycles/second (Hz). Harmonics are additional cycles superimposed on the 60 Hz cycle curve. The total load comprises the basic sine wave of the expected system load plus the harmonics generated, resulting in a much larger total than the expected load. Harmonics are oftentimes caused by unbalanced loads; such as produced by single phase motors, temporary faults on the line or equipment and by the use of semiconductors, etc. Harmonics can be eliminated by directing them to the ground on a grounded "Y" of a "Y"-Delta connection at the transformer bank. This requires a strong ground at the transformer bank. As earlier mentioned, good ground is helpful when lightening strikes a utility pole. The speed of discharging a lightening strike minimizes damages to system components. Lightening strikes can be in excess of 5000 amps, therefore a strong ground is essential to accommodate such high currents. The present invention is applicable to any and all of the aforementioned problems. Although various polymer backfill materials are preferred, the method improves the grounding performance of a wide variety of polymer backfill materials useful pole setting and/or resetting agents.

The present invention simultaneously improves the stability and grounding of modern electrical transmission lines and other utility poles. Electrical systems use the crust of the earth as part of the return conductor. The grounded, system neutral protects the phase conductors from excessive amperage and voltage as well as to help balance phase voltage and harmonics. Continuously grounded "static" shield wire's purpose is to get the excessive current of a lightening strike into the ground as soon as possible to avoid damage to the shielding conductors. Good grounding is particularly important today with the sophisticated electronic equipment currently widespread. Additionally, good grounding helps to minimize service interruptions. The need for good backfill materials to set and reset transmission line poles has been known for quite some time and good progress has been made in this area. By making any of the currently used backfill materials conductive, the surface area "connected" to the earth can be greatly enhanced.

For instance, the conventional method of connecting to the earth is a ⅝ths inch×10 foot ground rod driven into the earth. This method has a surface area of 235 $in^2$. A 10 inch×10 inch copper plate has a surface area of 100 $in^2$. A butt wrap ground of No. 6 copper wire, 20 feet long, wrapped around the pole will give a surface area of 75 $in^2$. This is compared to the surface area of a backfill, which is an approximately 20 inch diameter hole, 6 feet deep, giving a surface area in contact with the earth of up to 4500 $in^2$ which is 19 and 60 times bigger respectively. Therefore, the electrical contact with the ground is increased. This is important in the areas of poor soil conductivity. As was discussed in the background section above, U.S. Pat. No. 4,966,497 teaches the use of using a modified urethane as a pole backfill material. By expanding the physical properties of this backfill material to include electrically conductive capabilities, the surface area and abilities of the grounding are vastly improved to include electrical ground in addition to physical grounding.

BRIEF SUMMARY OF THE INVENTION

The present invention is directed to a composition and method of using a conductive polymer material as a backfill to set or reset utility poles, structures, or the like and to insure that the pole so set or reset is adequately grounded. The method comprises the steps of forming the polymer composition, dispersing the conductive material throughout the polymer composition, and applying the polymer composition to the utility pole, structure, or the like. The steps of forming, dispersing, and applying may be performed simultaneously or sequentially. In one embodiment, the step of dispersing the conductive material is performed before the step of applying the polymer composition. Preferably, the step of dispersing occurs before or simultaneous to the step of applying. Typically, this embodiment takes the form of dispersing the conductive material in one of the components that, when combined with other components, forms the polymer composition. In an alternative embodiment, the step of dispersing the conductive material is performed after the step of applying the polymer composition.

In the preferred embodiment of the present invention, the method of setting or resetting a pole, a structure, or the like in earth with a polymer composition comprises setting or resetting with a foamed polyurethane composition; the aforementioned step of forming comprises forming a foamed polyurethane composition the said step of applying comprises applying the foamed polyurethane composition.

In the preferred embodiment of the method, the foamed polyurethane having a conductive material dispersed throughout it, is formed in-situ.

In one embodiment of the method, the foamed polyurethane composition having a conductive material dispersed throughout it is formed in-situ at the pole by combining polyisocyanate, an organic alcohol component, an asphaltic component, a liquid water-immiscible component in an amount effective to allow formation of a foam of sufficient strength for holding the pole in the presence of water, a catalyst, a non-ionic surfactant, a flame retardant, and a conductive material. Preferably, the composition has a density of about 4–17 pounds per cubic feet and a compression of at least about 30 PSI.

In a specific embodiment, the step of forming the foamed polyurethane composition further comprises combining about 30–50% 4, 4'-diphenylmethane diisocyanate; about 0.01–30% asphaltic component; about 15–35% of amine phenolic or polyether polyol or combination of both; about 4–15% aromatic solvent water-immiscible component; up to about 2% silicone glycolcopolymer; less than 1% water; up to about 1% catalyst up to about 1% catalyst selected from the group consisting of amine-based catalyst, tin-based catalyst and a mixture of amine-based catalyst and tin-based catalyst; up to about 2% flame retardant and from about 1–20% of the conductive material.

In an alternative method embodiment, the foamed polyurethane composition having a conductive material dispersed throughout it is formed by combining about 39.8% of 4, 4'-diphenylmethane diisocyanate, about 11.8% of an asphaltic component, about 25% of one or of a combination of amine phenolic or polyether polyol, about 12.6% of a water-immiscible component, about 1.3% of silicone glycolcopolymer, about 0.2% water, about 0.3% of catalyst, about 1.6% flame retardant and about 7.3% of the conductive material.

In a preferred embodiment of the method, the step of dispersing conductive material comprises dispersing carbon particles or dispersing carbon fibers or dispersing both carbon particles and carbon fibers. In a specific embodiment, carbon fibers are present at 0.1–20% (w/w) of the total composition. Alternatively, the conductive material further comprises doping and coupling agents. The doping and coupling agents may comprise any of tetramethylammonium iodide, crown ethers such as 18-crown-6, and ligands.

In a specific embodiment of the method, the step of dispersing conductive material comprises dispersing is metal or metal alloy.

In another embodiment, the method further comprises adding a doping material to the polymer composition. In another embodiment of the method the doping material comprises a material selected from the group consisting of a crown ether and TMAI. In a specific embodiment, the crown ether is 18-crown-6.

In a specific embodiment, there is a method of resetting a pole or the like comprises excavating an area around a pole or the like and replacing excavated material with a polymer composition having a dispersing conductive material throughout it.

Another object of the present invention is a backfill composition comprising a polymer composition having a conductive material dispersed throughout it. Preferably, the polymer composition comprises a foamed polyurethane and the conductive material is carbon particles or carbon fibers or both. Alternatively, the conductive material is metal or metal alloy.

In another embodiment of the composition, the foamed polyurethane composition is produced by the process comprising combining polyisocyanate, an organic alcohol component, an asphaltic component, a liquid water-immiscible component in an amount effective to allow formation of a foam of sufficient strength for holding the pole in the presence of water, a catalyst, a non-ionic surfactant, and a flame retardant and, dispersing a conductive material throughout one or more of the components selected from the group consisting of the polyisocyanate, the organic alcohol component, the asphaltic component, the liquid water-immiscible component, the catalyst, the flame retardant, and the non-ionic surfactant. Preferably, the composition has a density of about 4–17 pounds per cubic feet and a compression of at least about 30 PSI. In another embodiment, the process comprises dispersing a conductive material throughout one or more of the components selected from the group consisting of the polyisocyanate, the organic alcohol component, the liquid water-immiscible component, the catalyst, the flame retardant, and the non-ionic surfactant. Preferably, the conductive material is dispersed throughout the 4,4'-diphenylmethane diisocyanate component.

In a specific embodiment, the composition, further comprises doping and coupling agents. In a further specific embodiment, the doping and coupling agents comprise one or more of tetramethylammonium iodide, crown ethers, and ligands.

In a another embodiment, the foamed polyurethane composition is produced by the process comprising combining about 30–50% 4, 4'-diphenylmethane diisocyanate, about 0.01–30% of an asphaltic component, about 15–35% of amine phenolic or polyether polyol or combination of both, about 4–15% of a water-immiscible component, up to about 2% silicone glycolcopolymer, less than 1% water, and up to about 1% catalyst selected from the group consisting of aminophenol, dibutyl tin, up to 2% flame retardant and 18-crown-6; and, dispersing a conductive material throughout one or more of the components selected from the group consisting of the about 30–50% 4,4'-diphenylmethane diisocyanate, the about 0.01–30% of an asphaltic component, the about 15–35% of amine phenolic or polyether polyol or combination of both, the about 4–15% of a water-immiscible component, the up to about 2% silicone glycolcopolymer, the less than 1% water; and, the up to about 1% catalyst selected from the group consisting of dibutyl tin, up to 2% flame retardant and 18-crown-6, such that the final composition consists of from about 0.1% to about 20% of the conductive material. Preferably, the conductive material is dispersed throughout the 30–50% of 4, 4'-diphenylmethane diisocyanate.

In a specific embodiment, the composition further comprises doping and coupling agents. In a further specific embodiment, the doping and coupling agents comprise one or more of tetramethylammonium iodide, crown ethers, and ligands.

In a preferred embodiment, the conductive material comprises carbon fibers or carbon particles or both.

In an alternative embodiment, the conductive material comprises tetramethylammonium iodide.

In yet another alternative embodiment, the conductive material comprises a mixture of carbon particles and tetramethylammonium iodide.

In yet another alternative embodiment, the conductive material comprises a metal or metal alloy.

In another embodiment of the invention, there is a method of grounding and setting substation ground mats and/or grids comprising excavating an area for the ground mat and/or grid and placing, over connecting copper wire, 3–6 inches of a composition comprising a foamed polyurethane polymer composition having carbon particles or carbon fibers or both carbon particles and carbon fibers as a conductive material dispersed throughout it.

In another embodiment of the invention, there is a method of grounding temporary substations comprising auguring holes around said substation, and applying, over conducting connections between the holes, a composition comprising a foamed polyurethane polymer composition having carbon particles or carbon fibers or both carbon particles and carbon fibers as a conductive material dispersed throughout it.

In another embodiment of the invention, there is a method of resetting and/or grounding a building comprising applying a composition comprising a foamed polyurethane polymer composition having carbon particles or carbon fibers or both carbon particles and carbon fibers at or near the foundation of said building.

It should be understood that in all cases, other suitable conducting materials may be used in place of the carbon particles or carbon fibers or both carbon particles and carbon fibers. The embodiments described above are merely illustrative and not exhaustive.

DETAILED DESCRIPTION OF THE INVENTION

As used herein, "a" or "an" means one or more.

As used herein, the term "amine-based catalyst" means any catalytic compound having at least one amino function. Examples include, but are not limited to, aminophenol and triethylamine.

As used herein, "asphalt" or "asphaltic component" is defined by its customary meaning, being a solid or semisolid mixture comprising bitumens obtained from native deposits or petroleum or by-products of petroleum or petroleum related industry processes. It consists of one or more hydrocarbons of greater than about sixteen carbon atoms. As used herein, the term "asphaltic component" means a composition comprising asphalt. Non-limiting examples of a commercial "asphalt" or "asphaltic component" include ChevronPhillips H.P.O. 830 and ExxonMobil S2.

As used herein in reference to backfill material, the term "conductive" means having a capacity to transfer electrons through the backfill material.

As used herein, the term "organic alcohol component" means a composition comprising a component having the formula R—$(OH)_n$ where n is at least one. Organic alcohol components can be simple alcohols or polyols.

As used herein, "TMAI" means tetramethylammonium iodide.

As used herein, the term "tin-based catalyst" means any catalytic compound having at least one tin atom. Examples include, but are not limited to, dibutyl tin and diethyl tin.

As defined herein, "water-immiscible" means that the solubility in water at about 70° F. is less than about 5 grams per 100 grams of water and preferably less than about 1 gram per 100 grams of water. The term "water-immiscible component" means any liquid material meeting the above-specified solubility requirement, but most preferably means aromatic solvents or mixtures thereof, such as those comprising toluene or xylenes, etc. A non-limiting example of a commercial "water-immiscible component" includes ExxonMobil SC150.

All percentages recited herein are percent by weight unless indicated otherwise.

Structural foundations are to transfer loads, in the case of utility poles, from some place above the ground into the soil. This transfer of load into the soil is dependent upon the strength of the soil and the size of the area that accepts the load. In general, for a utility wood pole foundation, it has been established that the embedded area (hole) required to support a pole is 10% of the height of the pole plus an additional two feet. (60 cm). The more uniform or undisturbed the soil is at the pole/soil interface, the less deflection of the pole will occur.

Foam backfill used for grounding provides the perfect medium to transfer the load because of its total uniformity and its intimate contact with the soil. Because of these attributes, the soil is loaded uniformly and the structure will support more load with less ground line defection. The requirements for the backfilling foundations on structures supporting aerial loads makes them a prime candidate for using foam backfill and when the backfill is electrically conductive, the foam serves two functions; supporting the structure and grounding the structure.

Foam backfill with grounding additives would benefit several kinds of structures, such as wood poles, concrete poles, metal poles and fiberglass poles. In addition, the combination of structure types such as those with concrete lower sections and steel upper sections would be good candidates. Another plus with the pre-cast concrete foundation is that it can be "foamed" in place as the hole is excavated, therefore eliminating the problems of needing anchor bolt alignment and rebar placement while trying to pour the concrete at the same time.

Other variations of foundation installation might include pre-casting concrete tubes with anchor bolts assemblies cast into the concrete tubes. The tube is trucked to the power line right of way and rolled to its final location. The hole is then excavated and the concrete tube is lowered into the hole, aligned and "foamed" in place with the conductive foam. The excavated spoils are then placed inside the pre-cast tube before the structure itself is attached to the pre-cast concrete tube. This method eliminates a great deal of right of way clean up.

It must be noted, that in using fiberglass and concrete embedment of any type, it would be expedient to place a ground wire into the annulus so the conductive foam can make a connection to the structure and system neutral.

Also, it may be beneficial in some cases to place a ground rod in the backfill either before the backfill is installed or after the backfill is in place. After the backfill has been installed, a ground rod may simply be driven into the backfill. This greatly expands the contact area of the ground rod.

The process of accomplishing conductive backfill material is realized by dispersing conductive materials compatible with the modified urethane foam system. Preferably, these materials are innately conducting. It has been found that the conductive materials disclosed herein provide continuous electrical pathways through the polymer matrices generally, and particularly through urethane foam, giving such polymer matrices properties similar to commonly used conductors.

Any number of conductive materials are applicable in the present invention. In one possible system, TMAI is homogeneously dispersed or dissolved throughout the polymer matrix, resulting in a conducting polymer. TMAI also may be used as a doping and coupling agent. Other salts are also possible, particularly those having organic moieties and possessing formal charge. Alternatively, any organic or inorganic salt which imparts conductivity to the polymer matrix is within the scope of the present invention. Neutral molecules such as some conjugated organic molecules are also useful. Preferably, carbon particles, carbon fibers, or both carbon particles and carbon fibers may be used. Preferably, a mixture (preferably 1:1, by weight) of TMAI (or other conductive material) and carbon particles and/ or fibers is used. When non-dissolving or partially dissolving particles and/or fibers such as carbon particles and/or fibers are used, the imparted conductivity is optimized as the particles becomes smaller. Ideally, particles of micron-scale dimensions work best. Metals or metal alloys may also be used. Wide dispersal of the conductive material throughout the polymer matrix maximizes conductivity. For example iron, copper, or other metal filings may be used. Alternatively, steel filings may be used. It is also possible to use materials which become conducting in the presence of another material or external stimulus.

A wide variety of polymers are useful as the polymer matrix in the present invention. These can be polyesters, polyamides, polyolefins, as well as others. Preferably, polyurethane foam is used as the polymer matrix. Although the examples focus on polyurethane foam, it should be understood that any suitable polymer matrix loaded with conductive material is useful in the present invention.

Although a number of different polymers and polymer compositions are amenable to the invention, the polymer composition found to be preferred in the present invention is a polyurethane foam composition. There are standard methods known in the art for the production of polyurethane foam compositions. Polyurethane foam may be produced by reacting a polyisocyanate with a group containing active hydrogen such as a polyol. A polyisocyante, such as OCN—R—NCO (containing the organic radical —R—) reacts with an organic alcohol molecule such as one represented by the general formula $R—(OH)_n$, where n is at least one, a low molecular weight and liquid resinous material containing a long chain organic radical —R— (polyester radical chain, for example) and having groups containing active hydrogen atoms such as the OH groups. The organic alcohol can be a simple alcohol or a polyol. The polyisocyanate serves two functions; first as a resin reactant to link two or more molecules of resin (OH—R—OH) to form a larger molecule of solid resin; and second, to react with polyisocyanate to form gaseous $CO_2$ which serves as the blowing agent causing foam formation. Illustrative examples of the polyisocyanate include polymeric diphenylmethyl diisocyanate, and others. An illustrative example of the polyol is 4,4'-diphenylmethane diisocyanate. Other specific compounds may be used in each case.

The conductive material may be introduced in any way into the final polymer matrix. Ideally, the dispersed conductive material is introduced as a homogenous solution or mixture with one or more of the individual reactants which form the polymer in-situ at the reinforcement location. Preferably, in the case of polyurethane foams, the dispersed conductive material is introduced as a homogeneous solution or a mixture of the 4,4'-diphenylmethane diisocyanate. It may also be alternatively introduced as a homogeneous solution or mixture of any of the other reactant components. Alternatively, the conductive material may be added to the fully prepared polymer at some point prior to introduction of the polymer into the reinforcement location.

The steps of dispersing the conductive material throughout the polymer composition and applying the polymer composition to the pole or the like may be performed simultaneously or sequentially. Preferably, the step of dispersing is performed before the step of applying, however, alternatively, the step of applying may be performed before the step of dispersing or the two steps may be performed simultaneously.

Doping and coupling agents may be used in the present invention to modify and/or improve performance. Non-limiting examples of these include tetramethylammonium iodide, crown ethers, and ligands. A non-limiting example of a crown ether is 18-crown-6.

The conductive material may be of any nature and the physical dimensions may vary so long as the polymer matrix is rendered conductive. Preferably, the conductive material is fine particulate material. The particles are preferably of micron-scale dimensions. However, materials of larger dimensions may be used. Carbon fiber up to 0.25 inches in length establish electrical pathways through the carbon particles which accumulate around the cell wall and tie the carbon particles together so as to establish the electrical pathway. Any dimensions are suitable so long as the addition forms a homogenous, widely dispersed mixture. The only requirement is that the addition of the conductive materials renders to the polymer matrix a conductivity greater than that of the neat polymer and greater than earth.

The conductive material should be present in an amount of about 0.1% to about 20% of the total weight of the final backfill composition. Preferably, it should be present in a range of from about 0.1% to about 10%. Most preferably, it should be present in a range of from about 0.1% to about 7.5%. The carbon fibers are in the amount of 0.1 to 1%, preferably 0.6%.

In the general case for polyurethane foams, the composition is formed in situ by the combination of a polyisocyanate, an organic alcohol component, an asphaltic component, a liquid water-immiscible component in an amount effective to allow formation of a film of sufficient strength for holding the pole in the presence of water, a catalyst, a flame retardant, and a non-ionic surfactant. Preferably, the composition has a density of about 4 to 17 pounds per cubic feet and compression of at least about 30 PSI. By way of non-limiting example, the polyisocyanate may be 4,4'-diphenylmethane diisocyante, and the organic alcohol component may be amine phenolic or polyether polyol. The liquid water-immiscible component may be any aromatic solvent or any aromatic solvent mixture such as toluene, the various xylenes or mixtures thereof. Preferably, a mixture of xylenes is used, although other aromatic solvents may be used. A commercially available example of this component is ExxonMobil SC150. The asphaltic component may be a commercially available asphalt such as Chevron Phillips H.P.O. 830 or ExxonMobil S2. These commercial materials are merely illustrative examples and are not limiting. Non-limiting examples of the catalyst include aminophenol, and dibutyl tin; and the non-ionic surfactant may be, among others, silicon glycolcopolymer. Doping materials may be crown ethers such as 18-crown-6, and TMAI.

It is preferable to include a flame retardant component in the backfill composition described herein. The flame retardant helps in raising the overall flash point of the material for fire and safety. It also helps in the flow ability of the material. An illustrative but non-exhaustive list of flame-retardants include TCPP (tris (1-choloro-2-propyl) phosphate); TDCPP (tris (1,3-dichloro-2-propyl) phosphate); and TCEP (tris (2-chloroethyl) phosphate). Some illustrative and non-exhaustive commercial examples include Celltech TCEP Flame Retardant, and Fyrol CEF.

The following specific example illustrates the modification of a known backfill material with conductive carbon to provide a conductive polymer backfill material useful in the present invention.

The foamable compositions utilized in the present invention can vary widely with the requirements mentioned above. The following is representative of such formulations in which all parts are by weight. Note that the example contains references to specific commercial components are made, however, any equivalent of these components may be substituted therein.

| Component | Range | Preferred |
|---|---|---|
| 4,4'-diphenylmethane diisocyanate | 30–50% | 39.8% |
| Petroleum hydrocarbon Chevron Phillips H.P.O. 830 | 5–30% | 11.8% |

-continued

| Component | Range | Preferred |
|---|---|---|
| Amine phenolic or polyether polyol or combination of both | 20–35% | 25% |
| Aromatic Solvent ExxonMobil SC150 | 4–15% | 12.6% |
| Silicone glycolcopolymer | 0–2% | 1.3% |
| Carbon Fiber (at least 0.25 inches long) | 0.1–1% | 0.6% |
| Water | 0–1% | 0.20% |
| Aminophenol catalyst | 0–1% | 0.33% |
| Flame Retardant | 0–2% | 1.5% |
| 1:1 Mixture of Carbon Black and TMAI | 1–20% | 7.3% |

The method of the present invention may also to improve grounding an utility poles already in place. This method of resetting a pole is accomplished by creating more surface area on an existing electrical system by excavating a trench away from the poles that are already in place. The trench should be excavated to a depth where the moisture content of the soil is constant. The width of the trench can be wide or narrow, whichever is practical to excavate depending the method used for the excavation. The backfill material of the present invention is poured or installed in the bottom of the trench along with the copper wire that is encapsulated in the backfill material and connected to the pole ground and system neutral.

Another method of supplemental pole grounding on poles previously in place would be to excavate an area around the pole, similar to the way the pole inspection people do to inspect a pole. Rather than replacing the removed soil, the backfill material of the present invention would be installed around the excavated area and would provide additional grounding.

The backfill material and methods described herein can also be used in conjunction with substation ground-mats or grids. After the excavation is completed for the mat/grid and the ground-mat has been installed, 3"–6" of backfill material is placed over the connecting copper wire to increase the area of the grounding mat's connection with the earth.

Along the same line, temporary substations, i.e., power transformers on wheels, could best be grounded by auguring numerous holes around the transformer. Adequately sized copper wires that are connected between the temporary transformers and the holes would have backfill material poured over the copper wire that is in the hole, thus enhancing the copper wire to earth connection.

Consideration may also be made in areas of high soil resistivity when installing underground cable with the ground wire wound around the cable. (a sheath type of cable). It is beneficial to apply backfill material over the conductor in well-spaced intervals which will increase the grounding and also let the cable dissipate heat. This application also improves heat dissipation.

The present invention is also applicable to resetting and/or grounding other structures. In particular, buildings ranging from high-rise skyscrapers, mid-level buildings, down to one or two stories houses, etc., may be afforded enhanced foundational support and/or electrical grounding through the use of the present invention.

The backfill material of the present invention is well suited to electrical equipment with single-phase motors. In this way, the backfill material can perform better than a ground rod. The increased area will readily allow the unbalanced (reactive) load to connect with the distribution transformer and/or the power substation through the ground so the load can be balanced through the substation connection (Y–Δ)

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of setting or resetting a pole or a structure in earth with a polymer composition comprising forming said polymer composition, dispersing a conductive material throughout the polymer composition, and applying said polymer composition to said pole or structure.

2. The method of claim 1 wherein the step of forming comprises forming a foamed polyurethane composition and said step of applying comprises applying said foamed polyurethane composition.

3. The method of claim 2 further comprising forming the foamed polyurethane composition in-situ.

4. The method of claim 2 wherein said step of forming the foamed polyurethane composition in-situ comprises combining polyisocyanate, an organic alcohol component, an asphaltic component, a liquid water-immiscible component in an amount effective to allow formation of a foam of sufficient strength for holding the pole in the presence of water, a catalyst, a non-ionic surfactant, a flame retardant, and a conductive material.

5. The method of claim 4 wherein the composition has a density of about 4–17 pounds per cubic feet and a compression of at least about 30 PSI.

6. The method of claim 4 wherein said step of forming the foamed polyurethane composition further comprises combining about 30–50% 4,4'-diphenylmethane diisocyanate; about 0.01–30% of an asphaltic component; about 15–35% of amine phenolic or polyether polyol or combination of both; about 4–15% of a water-immiscible component; up to about 2% silicone glycolcopolymer; less than 1% water; up to about 1% catalyst selected from the group consisting of amine-based catalyst, tin-based catalyst, and a mixture of amine-based catalyst and tin-based catalyst; up to about 2% flame retardant and from about 1–20% of the conductive material.

7. The method of claim 6 wherein the 4,4'-diphenylmethane diisocyanate is about 39.8%, the asphaltic component is about 11.8%, the amine phenolic or polyether polyol or combination of both is about 25%, the water-immiscible component is about 12.6%, silicone glycolcopolymer is about 1.3%, water is about 0.20%, the catalyst is about 0.33%, about 1.6% flame retardant and the conductive material about 7.3%.

8. The method of claim 1 wherein said step of dispersing conductive material comprises dispersing carbon particles or dispersing carbon fibers or dispersing both carbon particles and carbon fibers.

9. The method of claim 8 wherein the carbon fibers are present at 0.1–20% (w/w) of the total composition.

10. The method of claim 8 wherein said step of dispersing conductive material further comprises dispersing doping and coupling agents.

11. The method of claim 10 wherein said doping and coupling agents comprise one or more of tetramethylammonium iodide, crown ethers, and ligands.

12. The method of claim 1 wherein said step of dispersing conductive material comprises dispersing metal or metal alloy.

13. The method of claim 1 further comprising adding a doping material to said polymer composition.

14. The method of claim 13 wherein said doping material comprises a material selected from the group consisting of a crown ether and TMAI.

15. The method of claim 14 wherein said crown ethers 18-crown-6.

16. The method of claim 1 wherein said resetting comprises excavating an area around a pole and replacing excavated material with said polymer composition.

17. A foamed conductive polymer composition comprising:

a polyisocyanate, an organic alcohol component, an asphaltic component, a liquid water-immiscible component, a catalyst, a non-ionic surfactant, flame retardant and, a conductive material dispersed throughout said composition.

18. The foamed conductive polymer composition of claim 17 further having a density of about 4–17 pounds per cubic feet and a compression of at least about 30 PSI.

19. The foamed conductive polymer composition of claim 17 produced by the process comprising the step or dispersing the conductive material throughout the polyisocyanate.

20. The foamed conductive polymer composition of claim 17 further comprising doping and coupling agents.

21. The foamed conductive polymer composition of claim 20 wherein said doping and coupling agents comprise one or more of tetramethylammonium iodide, crown ethers, and ligands.

22. The foamed conductive polymer composition of claim 17 comprising:

about 30–50% 4,4'-diphenylmethane diisocyanate, about 0.01–30% of an asphaltic component, about 15–35% of amine phenolic or polyether polyol or combination of both, about 4–15% a water-immiscible component, up to about 2% silicone glycolcopolymer, up to 2% flame retardant, less than 1% water, and up to about 1% catalyst selected from the group consisting of amine-based catalyst, tin-based catalyst, and a mixture of amine-based catalyst and tin-based catalyst; and, a conductive material dispersed throughout said composition, at about 0.1% to about 20.

23. The foamed conductive polymer composition of claim 22 produced by the process comprising the step dispersing the conductive material throughout the 30–50% of 4,4'-diphenylmethane diisocyanate.

24. The foamed conductive polymer composition of claim 22 further comprising doping and coupling agents.

25. The foamed conductive polymer composition of claim 24 wherein said doping and coupling agents comprise one or more of tetramethylammonium iodide, crown ethers, and ligands.

26. The foamed conductive polymer composition of claim 22 wherein said conductive material comprises carbon fibers or carbon particles or both.

27. The foamed conductive polymer composition of claim 17 wherein said conductive material comprises tetramethylammonium iodide.

28. The foamed conducive polymer composition of claim 17 wherein said conductive material comprises a mixture of carbon particles and tetramethylammonium iodide.

29. The foamed conductive polymer composition of claim 17 wherein said conductive material comprises a metal or metal alloy.

30. A method of grounding and setting substation ground mats and/or grids comprising excavating an area for said ground mat and/or grid and placing 3–6 inches of the composition of claim 17 over connecting copper wire.

31. A method of grounding temporary substations comprising auguring holes around said substation, and applying the composition of claim 17 over conducting connections between said holes.

32. A method of resetting and/or grounding a building comprising applying the composition of claim 17 at or near the foundation of said building.

* * * * *